US011141880B2

(12) United States Patent
Maffett

(10) Patent No.: US 11,141,880 B2
(45) Date of Patent: Oct. 12, 2021

(54) AUTOMATED METHOD AND SYSTEM FOR FORMING PREFABRICATED VERTICAL WALL CONSTRUCTION UNITS

(71) Applicant: Charles Jerome Maffett, Athens, GA (US)

(72) Inventor: Charles Jerome Maffett, Athens, GA (US)

( * ) Notice: Subject to any disclaimer, the term of this patent is extended or adjusted under 35 U.S.C. 154(b) by 396 days.

(21) Appl. No.: 16/156,379

(22) Filed: Oct. 10, 2018

(65) Prior Publication Data

US 2020/0114540 A1 Apr. 16, 2020

(51) Int. Cl.

| | |
|---|---|
| ***B28B 3/10*** | (2006.01) |
| ***B28B 13/02*** | (2006.01) |
| ***B28B 17/00*** | (2006.01) |
| ***B28B 11/04*** | (2006.01) |

(52) U.S. Cl.
CPC ..... *B28B 3/10* (2013.01); *B28B 11/04* (2013.01); *B28B 13/022* (2013.01); *B28B 17/0081* (2013.01)

(58) Field of Classification Search
CPC ..... B28B 3/10; B28B 13/022
See application file for complete search history.

(56) References Cited

U.S. PATENT DOCUMENTS 2,839,810 A * 6/1958 Kovach ..... B28B 13/023 425/200
3,045,311 A * 7/1962 Oswalt ..... B28B 13/023 425/448

(Continued)

FOREIGN PATENT DOCUMENTS

CN 201291507 Y 8/2009
CN 203438377 U 2/2014

(Continued)

OTHER PUBLICATIONS

Amaco, Building with raw earth—Prefabricated rammed earth, herein Amaco, Dec. 16, 2016, https://www.youtube.com/watch?v=WFddMSRel4A (Year: 2016).*

(Continued)

*Primary Examiner* — Timothy Kennedy
(74) *Attorney, Agent, or Firm* — Mitch Harris, Atty at Law, LLC; Andrew M. Harris

(57) ABSTRACT

A method and system for forming vertical wall construction units in one or more provided forms provides environmentally-manageable construction with reduced labor burden over existing non-traditional construction techniques. The method is a method of operation of the system, which includes a programmable controller, a reciprocating tamper head, a positioner that is guided to position the tamper head, and a filling mechanism for introducing loose material to a form in pre-determined layer volumes to provide loose material for individual layers of the prefabricated vertical construction unit. The programmable controller operates the filling mechanism to introduce the loose material for the current layer, then operates the three-axis positioner to guide the reciprocating tamper head over a horizontal cross-section of the form at a height determined for the current layer and along a program-determined path to compact the current layer. The process is repeated until the compacted material reaches a programmed height.

15 Claims, 9 Drawing Sheets

(56) References Cited

U.S. PATENT DOCUMENTS

| | | | | | |
|---|---|---|---|---|---|
| 3,621,086 | A * | 11/1971 | Gulde | B28B 19/00 | 264/71 |
| 4,903,450 | A * | 2/1990 | Adams | E02D 27/02 | 52/293.2 |
| 5,074,774 | A * | 12/1991 | Nose | B29C 31/066 | 425/148 |
| 7,147,707 | B2 | 12/2006 | Murakami et al. | | |
| 7,641,461 | B2 | 1/2010 | Khoshnevis | | |
| 2003/0006521 | A1* | 1/2003 | Rivola | B28B 13/022 | 264/101 |
| 2003/0167729 | A1 | 9/2003 | Murakami et al. | | |
| 2004/0079035 | A1* | 4/2004 | Takagi | B28B 7/0085 | 52/97 |

FOREIGN PATENT DOCUMENTS

| | | | |
|---|---|---|---|
| CN | 107347278 | A | 11/2017 |
| CN | 107792678 | A | 3/2018 |
| CN | 107858933 | A | 3/2018 |
| RU | 2659362 | C1 | 6/2018 |

OTHER PUBLICATIONS

Auroville Earth Institute, Stabilised Earth Waterproofing, Mar. 21, 2016, https://web.archive.org/web/20160321074828/http://www.earth-auroville.com/stabilised_earth_waterproofing_en.php (Year: 2016).*

Green Prophet, Build your next home with dirt (and a robot!), downloaded from https://www.greenprophet.com/2017/07/build-your-next-home-with-dirt-and-a-robot/ on Oct. 8, 2018, 8 pages (pp. 1-8 in pdf).

BIM News, "Researcher Studies Potential for 3D-Printed "Dirt Houses"", downloaded from https://www.bimcommunity.com/news/load/899/researcher-studies-potential-for-3d-printed-dirt-houses on Oct. 8, 2018, 5 pages (pp. 1-5 in pdf.).

Birznieks, Lauris, "Designing and Building with Compressed Earth", Delft University of Technology, Dept. of Architectural Engineering, Architectural Engineering Graduation Studio, Apr. 2013, 44 pages (pp. 1-44 in pdf), Netherlands.

Smith, et al., "Adobe, pressed-earth, and rammed-earth industries in New Mexico", New Mexico Bureau of Mines & Mineral Resources, SOCORRO 1989, Nov. 1989, 60 pages (pp. 1-60 in pdf), Authority of State of New Mexico, NMSA 1953 Sec. 63-1-4, US.

Fix, et al., "Viability of Rammed Earth Building Construction in Cold Climates", Ryerson University, Dept. of Architectural Science, May 2009, 18 pages (pp. 1-18 in pdf), Canada.

Windstorm, Bly, "A Report of Contemporary Rammed Earth Construction and Research in North America", International Workshop on Rammed Earth Materials and Sustainable Structures & Hakka Tulou Forum 2011: Structures of Sustainability at International Symposium on Innovation & Sustainability of Structures in Civil Engineering, 2011, 10 pages (pp. 1-10 in pdf), Xiamen University, China.

* cited by examiner

AUTOMATED METHOD AND SYSTEM FOR FORMING PREFABRICATED VERTICAL WALL CONSTRUCTION UNITS

BACKGROUND OF THE INVENTION

1. Field of the Invention

The present invention relates generally to dirt-wall construction and robotic building methods, and in particular to an automated method and system for forming prefabricated vertical wall construction units.

2. Description of the Related Art

Typical building construction, and the materials involved, present a high environmental burden. When buildings are removed or demolished, the materials must be separated and handled appropriately in their disposal, in order to avoid creating an environmental hazard. Supporting the use of traditional building materials are the conveniences of prefabricated construction units, such as concrete wall sections, blocks or bricks.

Non-traditional building materials, such as compacted soil, also known as "rammed earth" have been used for millennia in building formation, but such construction is typically labor-intensive and slow, as the building itself is formed by constructing forms on-site, and then introducing and compacting soil or other materials such as straw/soil mixtures manually. Other alternative building schemes such as straw bale construction provide unitized construction materials, but the exterior and interior walls must typically be finished, which is again, a labor-intensive process.

Increasingly, there are standards in place for building construction in various municipalities and regions that require that buildings be made from materials that can be demolished in-place without presenting an environmental hazard. Carbon neutrality, i.e., net-zero carbon emissions building requirements are among these construction limitations that are becoming prevalent in various locales.

Therefore, it would be desirable to provide for building construction using environmentally-manageable materials that does not have the labor-intensive requirements of existing non-traditional building construction techniques.

SUMMARY OF THE INVENTION

The above objectives of providing environmentally-manageable construction materials with a reduced labor burden is accomplished in a method and system for forming prefabricated vertical wall construction units and the resulting prefabricated vertical wall construction units.

The method is an operation of the system, which forms the vertical wall construction units in one or more provided forms. The system includes a programmable controller, a reciprocating tamper head, a three-axis positioner coupled to the programmable controller that is guided programmatically by the programmable controller to position the tamper head, and a filling mechanism coupled to the programmable controller for introducing loose material to a form in predetermined layer volumes to provide loose material for a current layer of the prefabricated vertical construction unit. The form has an inner length and width shaped for forming the prefabricated vertical construction unit and a height exceeding a height of the prefabricated vertical construction unit. The programmable controller operates the filling mechanism to introduce the loose material for the current layer, then operates the three-axis positioner to guide the reciprocating tamper head over a horizontal cross-section of the form at a height determined for the current layer and along a program-determined path to compact the current layer. The height increases for subsequent layers, and the programmable controller operates the tamper during the guiding to tamp the loose material for the current layer to form a compacted current layer, and then alternatively activates the filling mechanism and the three-axis positioner to compact a next layer as the current layer until a top of the compacted current layer reaches the height of the prefabricated vertical construction unit.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure shows a system and method that form prefabricated vertical construction units for use in forming building walls. The vertical construction units are compacted in layers by the system, which introduces an amount of loose material for each layer, and then compacts each layer by guiding a robotically-positioned tamper head around the inside of a form before introducing the loose material for the next layer. The loose material is generally soil/gravel (aggregate) that has about 10%, e.g., between 5% and 15% moisture content, but may include other environmentally-manageable material such as straw or hemp. As used in the present disclosure, a slurry of semi-liquid material such as concrete, asphalt, plastics or other materials cured by chemical reaction or cooling from a heated state are not "loose material." After the layer height reaches a predetermined level for an individual vertical construction unit, the form is stripped, the vertical construction unit is dried and then optionally coated with a waterproofing sealer or a sealer/primer (or both) or lime white wash before being transported to a construction site and used along with other vertical construction units to build a structure, which is generally completed with a steel or wood roof system and standard windows/doors. The height of the vertical construction units is programmable, so that short vertical construction units can be provided for insertion of windows and lintels. The resulting construction units provide a consistent quality of appearance and physical properties as long as the same materials are used for each unit in a set of vertical construction units, and also provide units of identical length and width for each of the vertical construction units made with an identical (or the same) form. The height of the vertical construction units is also controlled, so that for construction units made with the same programmed height, substantially identical heights are produced. This uniformity contrasts with typical rammed-earth building, in which the walls are made with a single formwork into which the materials are introduced and tamped by hand, and thus have variations due to the form and technique of the construction workers.

Figure 1A:
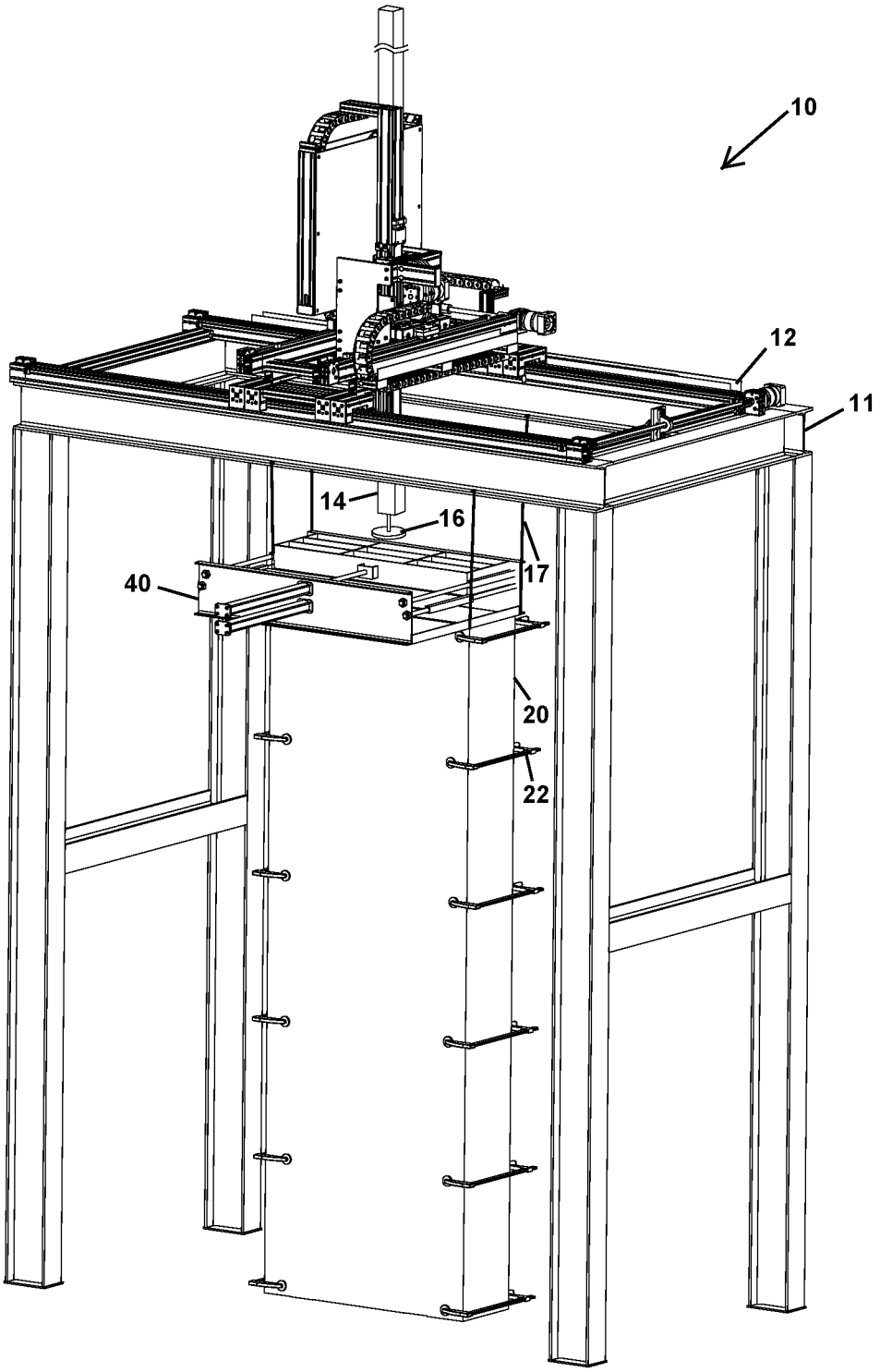
FIG. 1A is a perspective view.
Figure 1B:
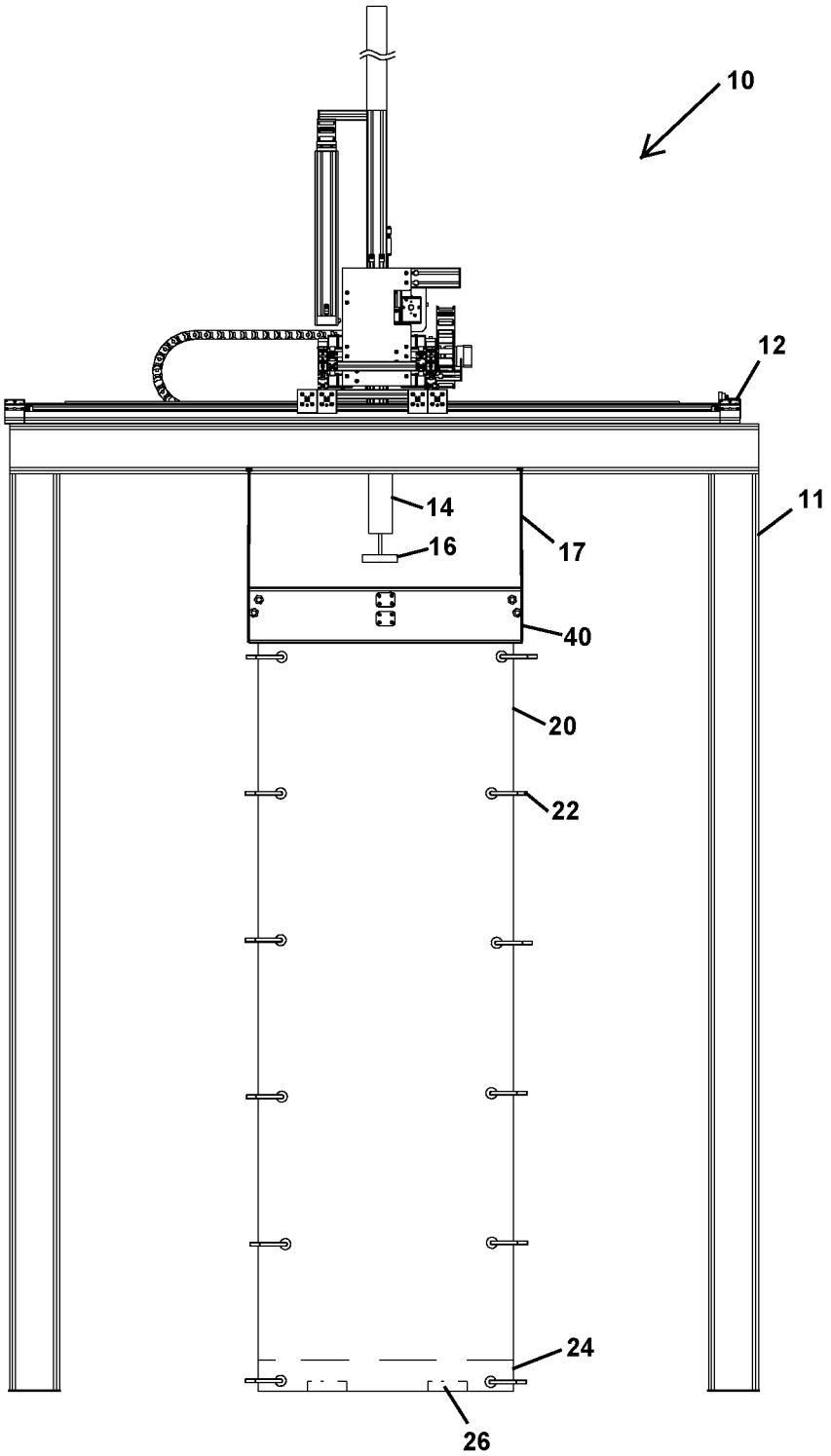
FIG. 1B is a front view, of an example system in accordance with an embodiment of the disclosure.

Referring now to FIGS. 1A-1B, an example system 10 in accordance with an embodiment of the disclosure is shown. A platform 11 having support legs forming a tower and appropriate bracing, supports a three-axis positioner 12 that moves a tamper head that includes a tamper drive 14 and tamper 16. Platform 11 will generally be secured to a floor of a building in which system 10 is installed, such as by base plates welded onto the bottoms of uprights of platform 11 and nuts secured to bolts cast in the building foundation floor, or by securing platform to the structure of a steel building, in which case uprights may not be required on platform 11. The diameter of tamper 16 is approximately 14 cm (5.5) inches, but tamper 16 may be of different sizes, depending on the size of the vertical construction unit to be formed. The width and length dimensions of the vertical construction units to be formed are determined by the inner width and length of a form 20 that is positioned beneath three-axis positioner 12 so that tamper 16 can be moved into form 20 at a height controlled by a z-axis extension of three-axis positioner 12 to which the tamper head is attached. Example form 20 is formed from planar material such as plywood having an adequate bursting strength to support the fabrication of the vertical construction unit, which is secured in the examples by a plurality of bar clamps 22. Form 20 may include reinforcing beams, may be a fixed form that is stripped by lifting, may be made from plate steel, or any other suitable form structure that can support the weight of the vertical construction unit, and the pressure present in form 20, particularly along the bottom edges of form 20. Referring to FIG. 1B, a concrete base insert 24 may be provided at the bottom of form 20 prior to formation of the vertical construction unit and include strap/forklift fork slots 26 to facilitate lifting the vertical construction unit after fabrication, either in or out of form 20. Further, while form 20 as illustrated in FIG. 1A is positioned under a middle portion of platform 11, in practice form 20 can be located near a forward edge of platform 11, to facilitate movement of form 20 and or concrete base insert 24 with a vertical construction unit formed atop concrete base insert 24.

Above form 20, and beneath three-axis positioner 12, a drawer assembly 40 is secured to a top of form 20 and provides for introduction of the loose material used to form a vertical construction unit. A plurality of cables (or chains) 17 are provided to support form 20 from tipping forward or backward within platform 11 and are generally attached to a top of form 20. However, in an alternative embodiment in which drawer assembly 40 is well-secured to the top of form 20, cables 17 may be attached to drawer assembly 40 and may optionally include a lift mechanism, such as pulleys, that can be used to raise and lower drawer assembly 40 before and after drawer assembly 40 has been fastened to form 20. Alternatively, drawer assembly 40 may be attached via other cables or another lift mechanism, including a rigid structure under mechanical or electromechanical control that can be used to raise and lower drawer assembly atop form 20. In such an implementation, drawer assembly 40 may not require structural attachment to form 20 and cables 17 may be temporarily attached to form 20 for safety, without connecting to drawer assembly 40 at all. Platform 11 will generally include an upper structure, such as a walk-around catwalk, permitting access to three-axis positioner 12 for service, for controlling the position of drawer assembly 40, for inspection of form 20, and as will be illustrated below, for controlling the introduction of the loose material to drawer assembly 40.

Figure 1C:
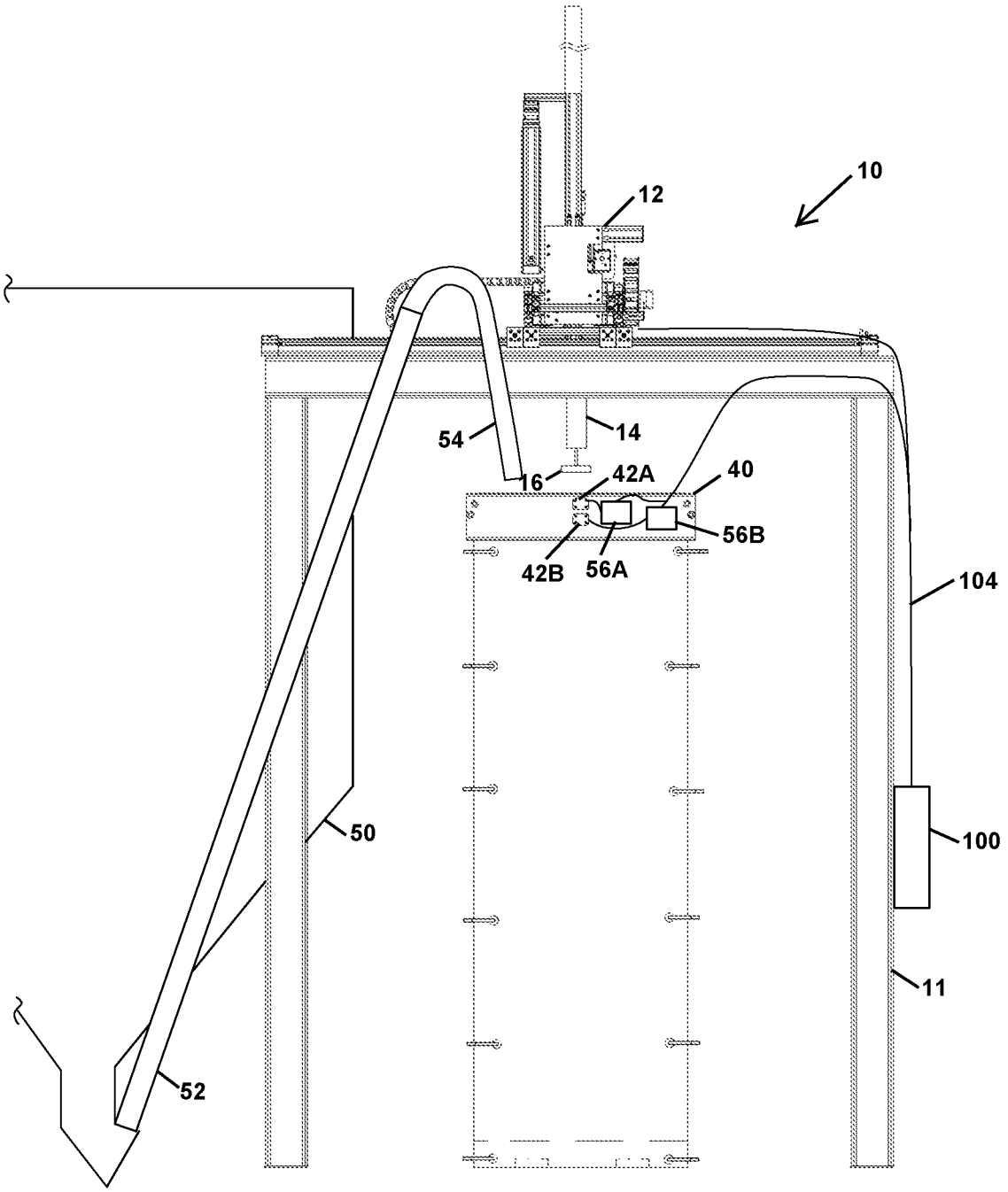
FIG. 1C is a front view of the example system of FIG. 1A and FIG. 1B, showing additional details.

Referring now to FIG. 1C, further details of system 10 are shown. Loose material is stored in a hopper 50 and introduced to a top face of drawer assembly 40 by an auger lift 52 and directed via a flexible outlet pipe 54. In alternative embodiments, other arrangements, such as manifolds and conveyer systems can be included to lift the loose material to atop drawer assembly 40 and fill the individual compartments of a drawer (not shown) that will be automatically dumped into form 20. System 10 includes a programmable controller 100 that controls the various electro-mechanical components of system 10 in a programmed sequence, in order to achieve the operations described in further detail below. Programmable controller 100 may be a programmable microcontroller unit, programmable logic controller (PLC) or a general-purpose computer or tablet, etc. Programmable controller 100 is shown attached to an upright of platform 11, but may be located wherever the operator is most appropriately positioned, such as atop a catwalk adjacent to the top portion of platform 11. Programmable controller 100 is connected via wiring 104 to drawer assembly 40, three-axis positioner 12 and optionally to a motor that drives auger lift 52. Programmable controller 100 thereby controls the introduction of loose material to drawer assembly 40, the transfer of loose material from drawer assembly 40 to form 20, and controls positioning of tamper 16 and operation of tamper drive 14 to tamp layers of the loose material within form 20. Programmable controller 100 also controls retraction tamper 16 from form 20 in order to operate drawer assembly 40 and to remove form 20 from the vertical construction unit or to move form 20.

Programmable controller 100 operates three axis motors of three-axis positioner 12, along with an electrically-operable air valve (not shown) that controls supply of shop air to tamper drive 14, which is supplied from a flexible hose contained in a housing atop three-axis positioner 12 that extends downward when the z-axis of three-axis positioner 12 is lowered to drop tamper 16 within form 20. Tamper drive 14 is a reciprocating air drive that oscillates in the z-axis when shop air is supplied to tamper drive 14. Programmable controller 100 also operates two electrically-controlled air valves 56A, 56B that control the supply of shop air to two respective air pistons 42A, 42B that move the components of drawer assembly 40 as will be described in detail below. While the illustrated system 10 is an electrically-controlled pressurized-air and electric motor hybrid system, other implementations may include hydraulic or electric pistons, tamper drive and drawer operations with suitable controls provided from programmable controller 100, without deviating from the spirit and scope of the disclosure.

Figure 2A:
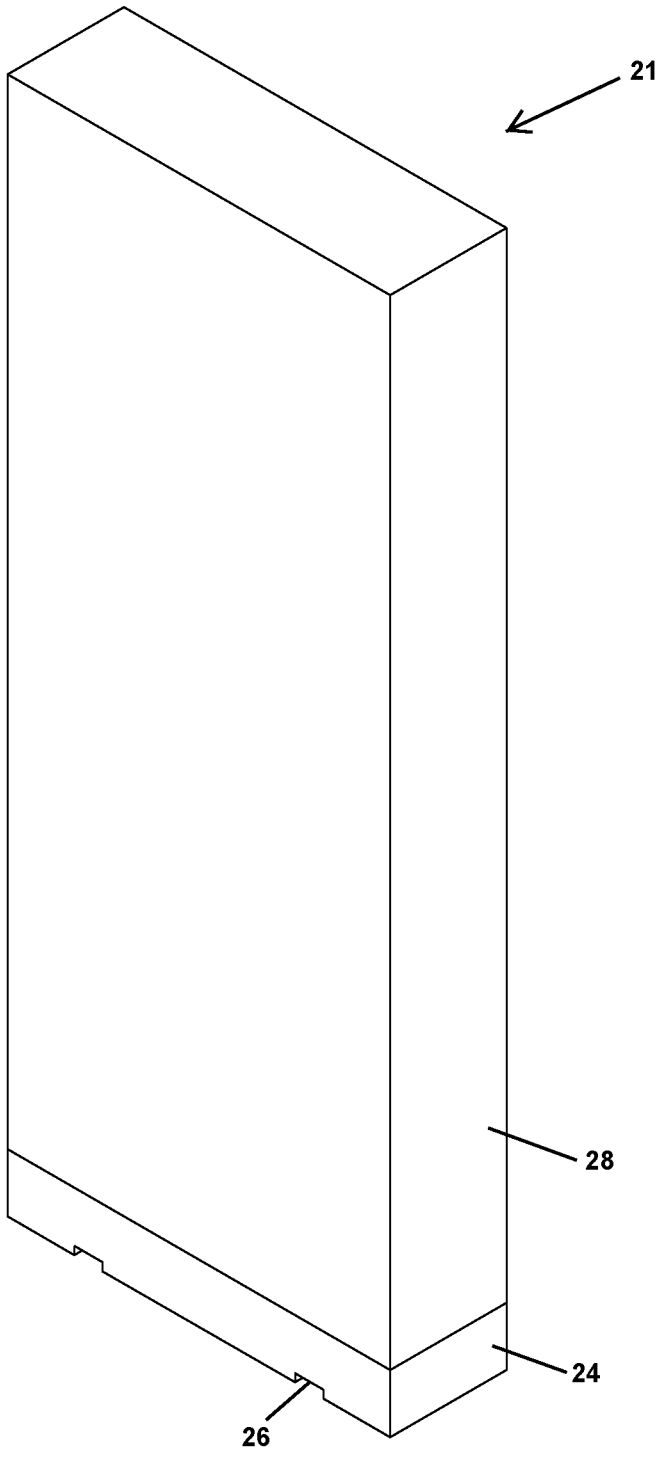
FIG. 2A is a perspective view showing an example vertical construction unit formed by an example method according to the disclosure by the system of FIGS. 1A-1C.

Referring now to FIG. 2A, an example vertical construction unit 21 that may be fabricated by system 10 is shown. Example vertical construction unit 21 consists of compacted material 28 that has been compacted layer-by-layer by alternating introduction of the loose material to form 20 and operating tamper drive 14, while guiding tamper drive 14 around a pre-programmed path to compact the loose material for the layer. Subsequently, vertical construction unit 21 is cured by drying and then optionally waterproofed and/or primed. As a result, vertical construction unit 21 made by the disclosed method and system can be detected by the layers formed in the compacted material 28 making up vertical construction unit 21. The disclosed drawer height is 7.6 cm (3"), which yields layers that are not readily visible when looking at a wall formed by system 10, but can be observed via close inspection. If readily visible layers are desired, the drawer height can be increased to 101 cm (4") in order to yield a vertical construction unit in which the layers are readily visible and yield their aesthetic appearance in the final product. The illustrated length of the vertical construction unit 21 is one meter (3.28 ft) and the width is 30 cm (11.8"), but other sizes can be accommodated by constructing an appropriate form 20, e.g., a 1.22 m (4 foot) by 30.5 cm (1 foot) wall section can be made by a form having those inner dimensions. As described above, concrete base insert 24 is included at the bottom of vertical construction unit 21 and can be at least partially cured when vertical construction unit 21 is formed. The illustrated concrete base insert 24 is dimensioned to the length and width of the form, has a height of 15.3 cm (six inches) and includes strap/forklift fork slots 26 for transport. The height of illustrated vertical construction unit 21 is 2.74 m (nine feet), and form 20 has a height of 2.90 m (nine-and-a-half feet), as form 20 must extend a few inches over the maximum height of vertical construction unit 21 to retain the loose material before and during compaction. Since the height of vertical construction unit 21 is controlled by the number of layers of loose material introduced to form 20 by drawer assembly 40 and compacted with tamper 16, the height of vertical construction unit 21 can be a programmable parameter of programmable controller 100, and a single form 20 can be used to make vertical construction units 21 of virtually any specified height, from about 15.3 cm (six inches), up to the height capacity of the tallest form 20 that system 10 can accept.

Figure 2B:
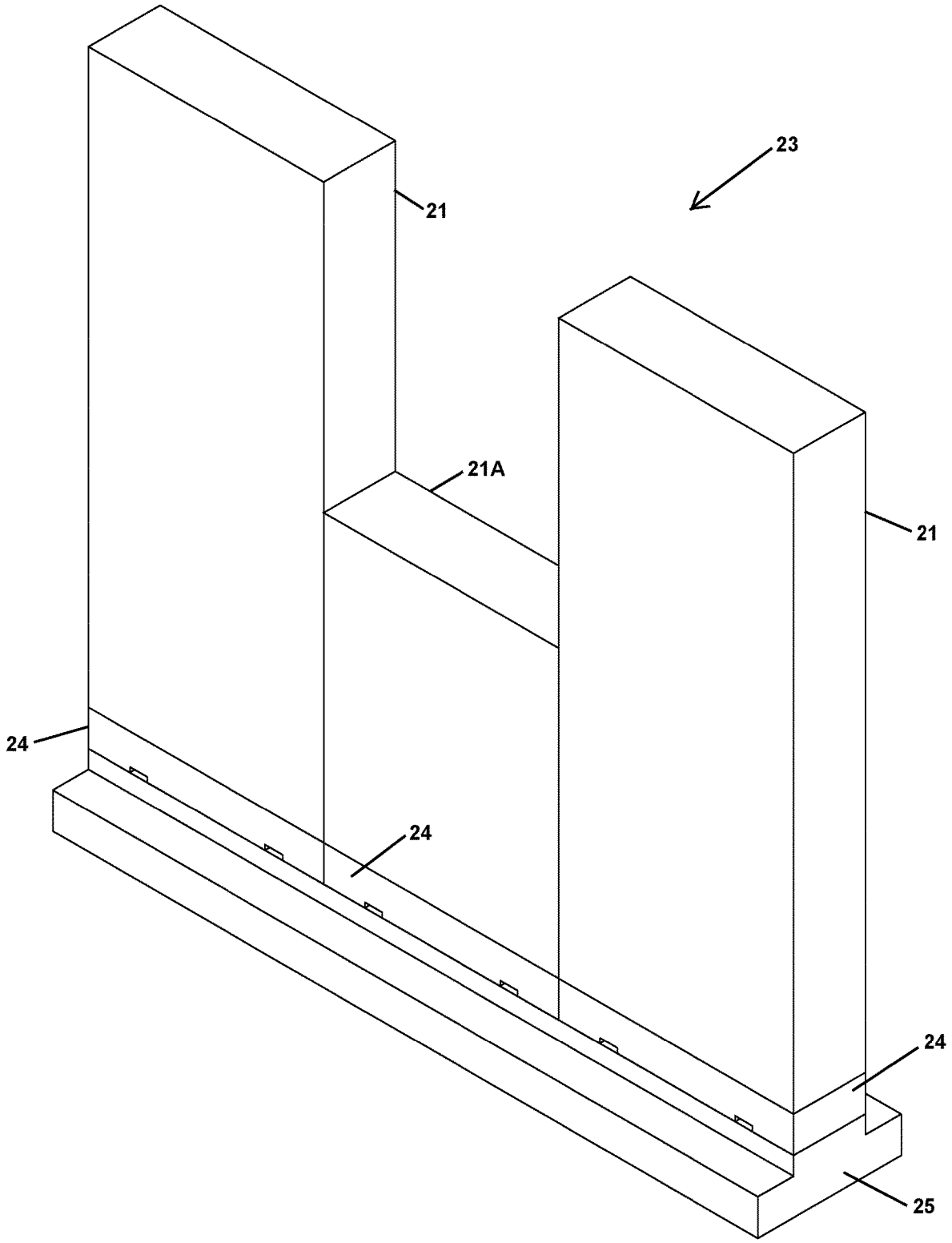
FIG. 2B is a perspective view showing an example of building construction using vertical construction units formed by the example method according to the disclosure by the system of FIGS. 1A-1C.

Referring now to FIG. 2B, an example installation of vertical construction units 21, 21A to form a building wall 23 are shown. While the illustrated vertical construction units 21, 21A are formed with flat sides for illustrative purposes, in general, a tongue-and-groove cross-section as described in further detail below, is preferred to provide lateral support. A shorter vertical construction unit 21A is provided to accommodate, for example, a window. Vertical construction units 21, 21A are transported to a jobsite via truck and/or rail, and are lowered into position atop a reinforced foundation stem-wall 25 that may be poured with or without an adjacent slab. Vertical construction units 21, 21A may be face-bonded with a reinforced liquid bonding primer, or may be left as-is, depending on code and structural requirements.

Figure 3:
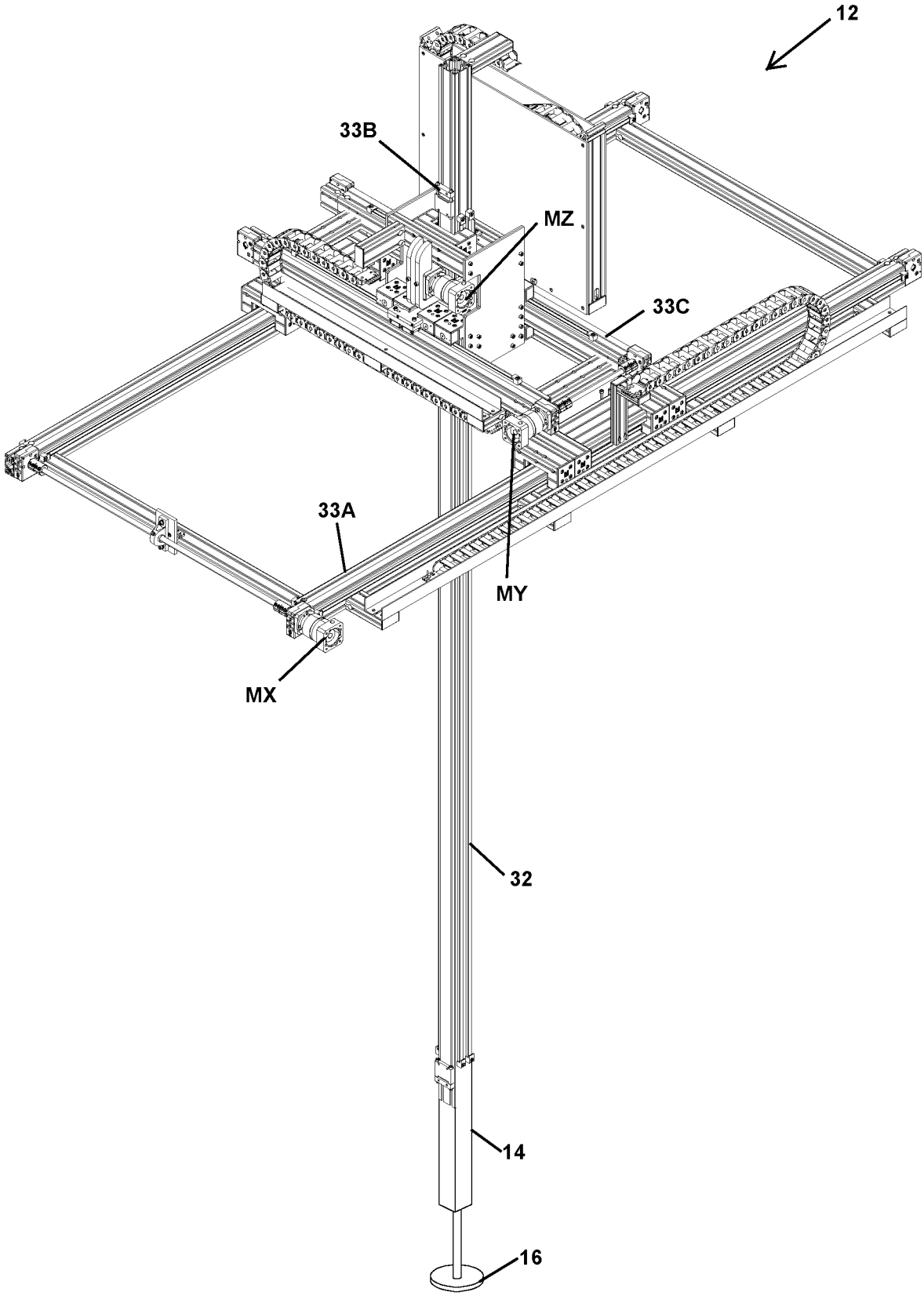
FIG. 3 is a detailed view of positioner 12 with attached tamper drive 14 and tamper 16.

Referring now to FIG. 3, an example embodiment of three-axis positioner 12 is shown connected to tamper drive 14 with tamper 16 attached. A z-axis extension 32 (boom) of three-axis positioner 12 must be rigid enough to hold tamper drive 14 steady at its maximum downward extension, approximately 3.66 m (12 feet), when tamper drive 14 is activated when located at the bottommost layer of a vertical construction unit being formed within form 20. A z-axis motor MZ controls the position of extension 32 along a z-axis track 33B, and thereby tamper 16 under programmatic control by programmable controller 100. Alternatively, tamper 16 may be manually operated once the height of tamper 16 has reached the proper height for a layer. An x-axis motor MX controls the lateral position of z-axis extension 32 along an x-axis track 33A and a y-axis motor MY controls the position of z-axis extension 32 along a y-axis track 33C.

Figure 4A:
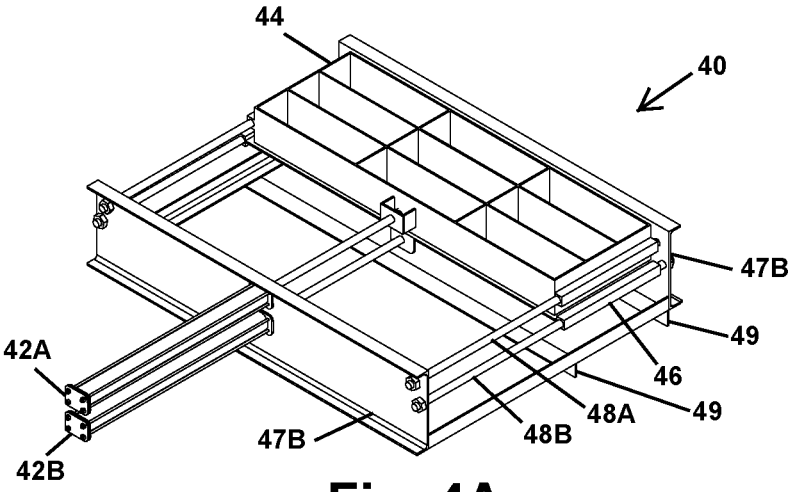
FIGS. 4A-4C are perspective views of drawer assembly 40 in different phases of operation in the system of FIGS. 1A-1C.
Figure 4B:
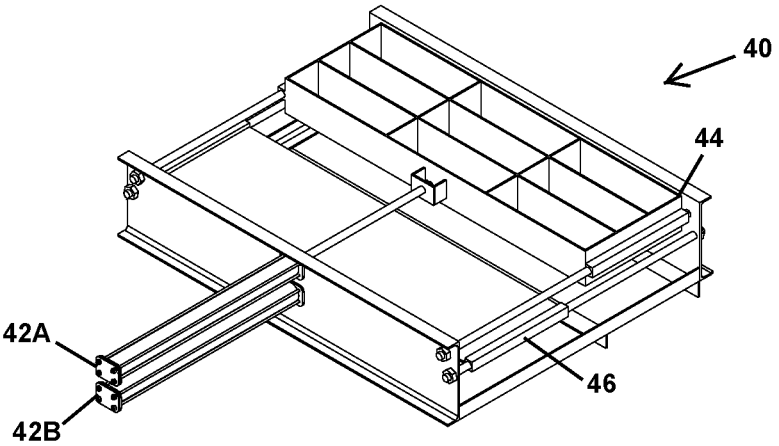
Figure 4C:
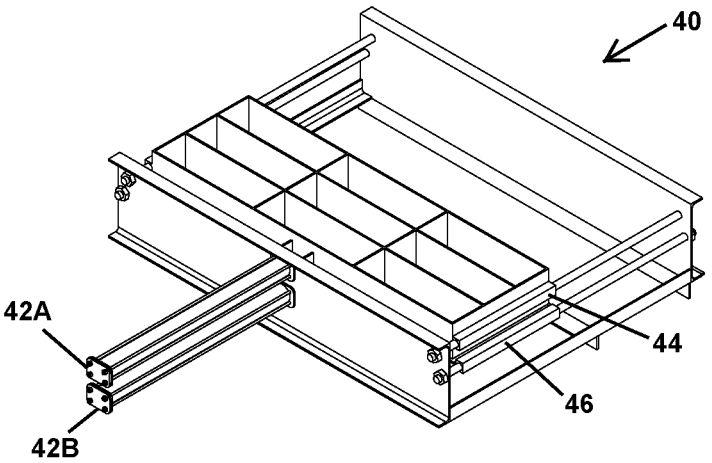

Referring now to FIGS. 4A-4C, details and operation of an example drawer assembly 40 are shown, in three different phases of operation as controlled by programmable controller 100. Drawer assembly 40 includes a multi-compartment drawer 44 that receives a layer portion of the loose material and compartmentalizes the loose material so that when the loose material is released over form 20 the distribution of the loose material is substantially even across the length and width of form 20. In example drawer 44, the individual compartments have dimensions of approximately 33 cm (thirteen inches) in length and 10.2 cm (four inches) in width, yielding a total length and width substantially equal to the one-meter (3.28 feet) by 30.5 cm (twelve inch) dimensions of example form 20. Drawer 44 and other components of drawer assembly 40 may be scaled for other form dimensions. Alternatively, for thicker walls, drawer 44 and an associated bottom plate 46 that rests under drawer 44 to retain the loose material within the compartments of drawer 44 may be filled and operated at multiple positions. For example, when constructing a wall 60 cm (23.6 in) or 61 cm (two feet) thick, drawer 44 may be filled and dumped atop the form 20 twice, once at the back of form 20 and once at the front of form 20, as an alternative to providing a drawer having a depth of (23.6 in) or 61 cm (two feet). As another alternative, drawer 44 may be wider than an inner width of form 20, with the filling operation only introducing the loose material to the portion of drawer 44 that corresponds to the width of form 20. Drawer assembly 40 is aligned with the inside top of form 20 by a pair of guide extensions 49 that project downward from drawer assembly 40 when drawer assembly 40 is mounted to or secured over the top of form 20. Two pairs of rails 48A, 48B disposed on either side of drawer assembly 40 slideably attach drawer 44 and bottom plate 46 to channels 47A and 47B forming a frame of drawer assembly 40. As mentioned briefly above, air piston 42A moves drawer 44 and air piston 42B moves bottom plate 46 to achieve multiple phases of operation, the middle of which is shown in FIG. 4A, with loose material (not shown) contained in drawer 44 and bottom plate 46 retaining the loose material within drawer 44. Once the loose material is positioned over form 20, air piston 42B is retracted by releasing air pressure via deactivating electrically-controlled air valve 56A and bottom plate 46 is withdrawn from beneath drawer 44 to release the loose material into form 20, reaching the position shown in FIG. 4B. Next, drawer 44 is retracted by air piston 42B by releasing air pressure via deactivating electrically-controlled air valve 56B and drawer 44 and bottom plate 46 are positioned for filling drawer 44 with the loose material for a next layer in the position shown in FIG. 5C. While the filling operation is being performed, three-axis positioner 12 moves tamper 16 down to a height predetermined for the current layer being formed, i.e., the layer corresponding to the loose material dumped in the transition to the phase shown in FIG. 5B, and tamper drive 14 is activated, causing tamper 16 to tamp the loose material for the current layer while guiding tamper 16 around the length and width of form 20.

Figure 5A:
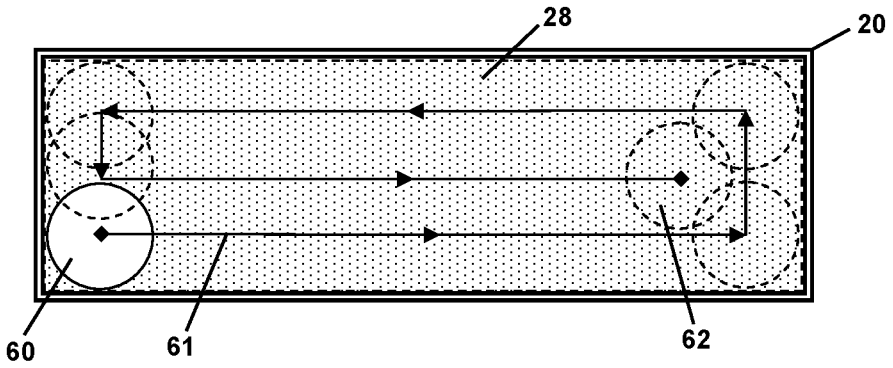
FIG. 5A is a top view of form 20 illustrating an example pattern of movement along a guided path of a tamper head in the system of FIGS. 1A-1C.

Referring now to FIG. 5A, an example guiding path for tamper 16 is shown. With tamper 16 starting at a position 60, a guiding path 61 proceeds in a counter-clockwise spiral covering the outer edges of form 20 with some tolerance to avoid collision of tamper 16 with the walls of form 20. After the outer edges of compacted material 28 have been tamped, the guiding path 61 spirals to the middle of form 20 until it reaches an end position 62, at which time tamper drive 14 is de-activated and three-axis positioner 12 retracts z-axis extension 32 and tamper 16 from form 20, so that drawer assembly 40 can be operated in the sequence illustrated in FIGS. 5A-5B to dump the loose material for forming the next layer.

Figure 5B:
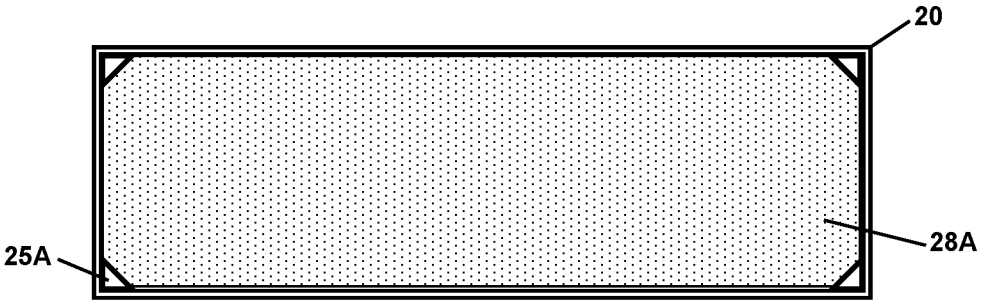
FIG. 5B and FIG. 5C are top views of form 20 illustrating insertion of example shapes that can be used to alter a cross section of a resulting vertical construction unit formed by the system of FIGS. 1A-1C.
Figure 5C:
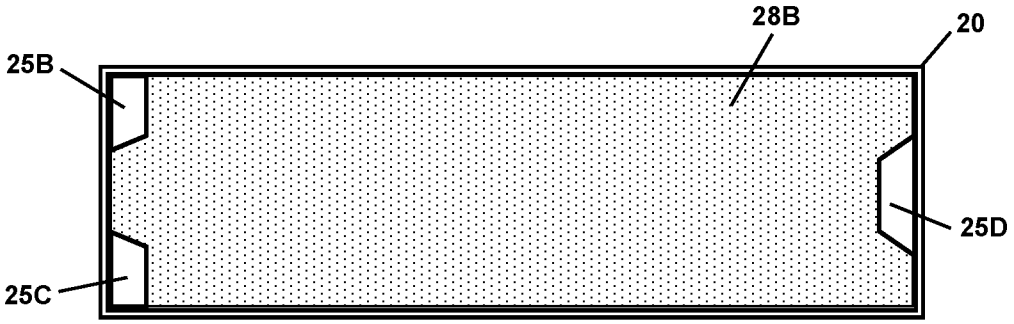

Referring now to FIGS. 5B-5C, insertion of various form inserts into form 20 is illustrated, which provide shaping of vertical construction units 21 formed by the above-described method. In order to avoid collisions of tamper 16 with form inserts, guiding path 61 of FIG. 5A may have to be modified to provide a tolerance distance between tamper 16 and the form inserts during operation. FIG. 5B illustrates insertion of corner chamfer inserts 25A that produce corners in compacted material 28A that are less susceptible to damage and further alleviate surface variations in walls formed from vertical construction units 21 that have some variation in their position. FIG. 5C illustrates insertion of inserts 25C-25D shaped to produce a tongue-and-groove shape in compacted material 28B that provides lateral stability to walls formed with vertical construction units 21. The illustrated inserts 25A-25D extend to the top of concrete base insert 24 or alternatively, if concrete base insert 24 is cast in form 20 or is pre-shaped to accept inserts 25A-25D, inserts 25A-25D may extend to the bottom of form 20 at the floor.

Figure 6:
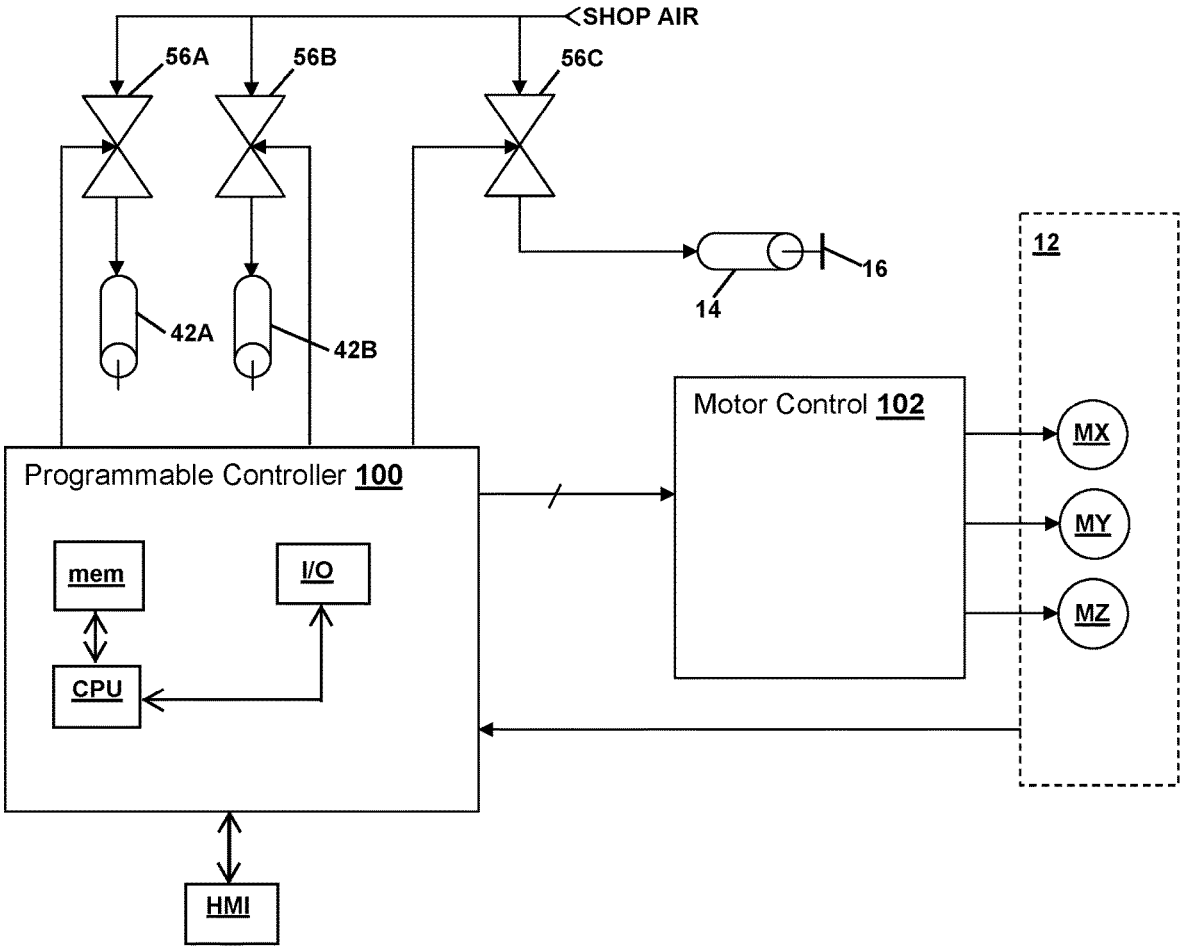
FIG. 6 is an example block diagram showing program-controlled elements in the system of FIGS. 1A-1C.

Referring now to FIG. 6, a block diagram of the program-controlled elements in the example system of FIGS. 1A-1C is shown. Programmable controller 100 includes a central-processing unit (CPU) CPU, such as a microcontroller or logic controller, coupled to memory MEM that stores data, such as position parameters, wall dimensions, programmed tamper guiding path shape, etc., and program code constituting a computer-program product for controlling the operation of system 10. As used in this Application, computer-program product refers to a set of program instructions that is not a signal or wave, but is a stored representation of the program code on a media such as a flash drive, CD-ROM, DVD ROM, or in memory MEM. Central-processing unit CPU is also coupled to input/output (I/O) circuits I/O that generate drive signals and receive feedback in the form of position indications and/or limit switch activations for controlling the position of three-axis positioner 12 via a motor control unit 102, which controls motors MX, MY and MZ. I/O circuits I/O also generate signals for controlling the application of shop air via electrically-controlled air valves 56A-56C to air pistons 42A, 42B and also to tamper drive 14. Programmable controller 100 also interfaces to a human-machine interface HMI, which may be a control pad, a tablet, a smart phone, a keyboard/mouse combination in a general purpose computer or another computer to provide for uploading program code, i.e., the computer-program product mentioned above, and to provide for control of the operation of system 10, e.g., commencing and shutting down operation and setting parameters for a given vertical construction unit.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A method of prefabricating a vertical construction unit from loose material, the method comprising:

providing a form having an inner length and width shaped for forming the prefabricated vertical construction unit and a height exceeding a height of the prefabricated vertical construction unit;

introducing the loose material to the form in a predetermined layer volume to provide loose material for a current layer of the prefabricated vertical construction unit by evenly filling a multi-compartment drawer with the loose material and then dumping the multi-compartment drawer into the form so that the loose material in individual compartments of the form lands atop a corresponding area of the current layer, wherein the multi-compartment drawer has a movable plate underneath, and wherein the dumping the multi-compartment drawer comprises under program control, positioning the movable plate underneath the movable bottomless drawer, filling the movable bottomless drawer with the loose material for the current layer, under program control, moving the movable bottomless drawer and the movable plate in concert over a top of the form, and under program control, retracting the movable plate from underneath the movable bottomless drawer to dump the loose material into the form;

guiding a tamper with a program-controlled positioner over a horizontal cross-section of the form at a height determined for the current layer and along a program-determined path to compress the current layer, wherein the height increases for subsequent layers;

operating the tamper during the guiding to tamp the loose material for the current layer to form a compacted current layer; and repeating the introducing the guiding and the operating for a next layer as the current layer until a top of the compacted current layer reaches the height of the prefabricated vertical construction unit.

2. The method of claim 1, wherein the program-determined path is a spiral path that guides the tamper around a perimeter of the horizontal cross-section of the form and subsequently through a center of the horizontal cross-section of the form.

3. The method of claim 1, wherein the positioning the movable plate further positions the movable bottomless drawer and the movable plate away from the top of the form so that the guiding and the operating can be performed while the loose material is introduced to the movable bottomless drawer, and wherein the method further comprises:

retracting the tamper from the form prior to move the movable bottomless drawer and the movable plate over the form;

subsequent to retracting the movable plate and after the loose material for the current layer has fallen into the form, retracting the movable bottomless drawer from atop the form; and subsequent to retracting the movable plate and the movable bottomless drawer from atop the form, extending a tamper head into the form to a height determined for the current layer.

4. The method of claim 1, wherein the providing a form provides a form having a cross section modified by inclusion of mold-shaping inserts that shape the prefabricated vertical construction unit to include one or more of chamfers or tongue and groove ends.

5. The method of claim 1, further comprising:

stripping the form to release the prefabricated vertical construction unit;

drying the prefabricated vertical construction unit; and applying a waterproofing coating to the prefabricated vertical construction unit.

6. The method of claim 5, further comprising applying a primer or lime whitewash prior to applying the waterproof coating.

7. The method of claim 1, further comprising, prior to the introducing, installing a concrete block having strap/forklift fork recesses formed in the bottom thereof within the form, whereby the prefabricated vertical construction unit can be moved via forklift or strap.

8. The method of claim 1, further comprising:

stripping the form to release the prefabricated vertical construction unit; and repeating the providing, introducing, guiding, operating and stripping to form multiple vertical construction units including the prefabricated vertical construction unit.

9. The method of claim 1, wherein a length of the prefabricated vertical construction unit is one meter (3.28 feet), wherein a width of the prefabricated vertical construction unit is 0.305 meters (one foot) and wherein a height of the prefabricated vertical construction unit is variable by repeating the introducing, guiding and operating for each of multiple vertical construction units until the current layer for reaches one of multiple predetermined heights to form differing predetermined numbers of layers for each of the multiple vertical construction units.

10. A system for forming prefabricated vertical construction units, comprising:

a programmable controller;

a tamper head;

a three-axis positioner coupled to the programmable controller that is guided programmatically by the programmable controller to position the tamper head; and a filling mechanism coupled to the programmable controller for introducing loose material to a form in pre-determined layer volumes to provide loose material for a current layer of the prefabricated vertical construction unit, wherein the filling mechanism comprises a multi-compartment bottomless drawer into which the loose material introduced that is mounted atop the form and has a width and a length sized to an inner width and length of the form, wherein the filling mechanism comprises a movable plate sized to cover a bottom of the multi-compartment drawer, and a second drive mechanism coupled to the programmable controller to move the movable plate from beneath the multi-compartment drawer to retract the movable plate to dump the loose material in the multi-compartment drawer into the form and to extend the movable plate beneath the multi-compartment drawer under programmatic control by the programmable controller, wherein the form is shaped for forming the prefabricated vertical construction unit and a height exceeding a height of the prefabricated vertical construction unit, wherein the programmable controller operates the filling mechanism to introduce the loose material for the current layer, then operates the three-axis positioner to guide the tamper head over a horizontal cross-section of the form at a height determined for the current layer and along a program-determined path to compact the current layer, wherein the height increases for subsequent layers, and wherein the tamper is operated during the guiding to tamp the loose material for the current layer to form a compacted current layer, and then the programmable controller activates the filling mechanism and the three-axis positioner to compact a next layer as the current layer until a top of the compacted current layer reaches the height of the prefabricated vertical construction unit.

11. The system of claim 10, wherein the program-determined path is a spiral path that guides the tamper around a perimeter of a horizontal cross-section of the form and subsequently through a center of the horizontal cross-section of the form.

12. The system of claim 10, wherein the programmable controller, in a soil-introducing sequence, first positions the movable plate and the multi-compartment drawer away from a top of the form so that the multi-compartment drawer can be filled with the loose material, second activates the first and second drive mechanisms to move the multi-compartment drawer and the movable plate over the form in concert, and third retracts the movable plate to dump the loose material into the form, and then repeats the sequence to distribute the loose material into the form for subsequent layers.

13. The system of claim 12, wherein the tamper head is coupled to the programmable controller to activate and deactivate the tamper head, wherein subsequent to positioning the movable plate and the multi-compartment drawer away from the top of the form and after the loose material for the current layer has been distributed into the form, the programmable controller operates a z-axis of the three-axis positioner to lower the tamper head into the form at the height determined for the current layer and then activates the tamper head and operates a y-axis and an x-axis of the three-axis positioner to guide the tamper head around the program-determined path as the tamper head compacts the loose material for the current layer, wherein subsequent to completing the program-determined path, the programmable controller operates the z-axis to retract the tamper head from the form, and wherein subsequent to the tamper head being retracted from the form, the programmable controller operates the first drive mechanism and the second drive mechanism to commence a soil-introducing sequence.

14. The system of claim 13, further comprising a motor-driven loose material mover coupled to the programmable controller for moving the loose material to above the multi-compartment drawer so that the loose material is moved while the tamper head is compacting the loose material for the current layer, so that the loose material for the next layer is introduced into the multi-compartment drawer.

15. A non-transistory computer readable medium containing program instructions for operating a system to form a prefabricated vertical construction unit, the system including a programmable controller having a processor for executing the program instructions, a tamper head, a filling mechanism coupled to the programmable controller, a three-axis positioner coupled to the programmable controller that is guided by the programmable controller executing the program instructions to position the tamper head, and wherein the program instructions comprise program instructions for:

operating the filling mechanism to introduce loose material to a form in pre-determined layer volumes to provide loose material for a current layer of the prefabricated vertical construction unit, wherein the programmable controller operates the filling mechanism to introduce the loose material for the current layer, then operates the three-axis positioner to guide the tamper head over a horizontal cross-section of the form at a height determined for the current layer and along a program-determined path to compact the current layer, wherein the height increases for subsequent layers, wherein the filling mechanism comprises a multi-compartment bottomless drawer into which the loose material introduced that is mounted atop the form and has a width and a length sized to an inner width and length of the form, wherein the filling mechanism comprises a movable plate sized to cover a bottom of the multi-compartment drawer, and a second drive mechanism coupled to the programmable controller and operated by the program instructions for operating the filling mechanism to move the movable plate from beneath the multi-compartment drawer to retract the movable plate to dump the loose material in the multi-compartment drawer into the form and to extend the movable plate beneath the multi-compartment drawer; and activating the tamper during the guiding to tamp the loose material for the current layer to form a compacted current layer, and then alternatively activating the filling mechanism and the three-axis positioner to compact a next layer as the current layer until a top of the compacted current layer reaches the height of the prefabricated vertical construction unit.

* * * * *